US006405656B1

(12) United States Patent
López Gómez et al.

(10) Patent No.: US 6,405,656 B1
(45) Date of Patent: Jun. 18, 2002

(54) DISSEMINATED TRACTION ARRANGEMENT APPLIED TO SINGLE-AXLE TRAIN WHEEL SETS PROVIDED WITH INDEPENDENT WHEELS

(75) Inventors: José Luis López Gómez; Faustino Archilla Aldeanueva; Antonio Prieto Carrillo, all of Madrid (ES)

(73) Assignee: Patentes Talgo, S.A., Madrid (ES)

( * ) Notice: Subject to any disclaimer, the term of this patent is extended or adjusted under 35 U.S.C. 154(b) by 0 days.

(21) Appl. No.: 09/711,181

(22) Filed: Nov. 13, 2000

(30) Foreign Application Priority Data

Nov. 18, 1999 (ES) ..... 9902538

(51) Int. Cl.[7] ..... B61D 17/20

(52) U.S. Cl. ..... 105/4.1; 105/8.1; 105/133; 105/180

(58) Field of Search ..... 105/73, 182.1, 105/199.5, 215.1, 215.2, 218.1, 4.1, 8.1, 133, 131, 180; 464/140

(56) References Cited

U.S. PATENT DOCUMENTS 1,508,226 A * 9/1924 Holy ..... 105/133
4,148,262 A * 4/1979 Eichinger ..... 105/131
4,690,068 A * 9/1987 Delfourne ..... 105/8.1
4,697,527 A * 10/1987 Eichinger ..... 105/133
5,445,082 A * 8/1995 Lenk ..... 105/4.1
6,113,499 A * 9/2000 Braun et al. ..... 464/140

FOREIGN PATENT DOCUMENTS

EP 0591088 4/1994
EP 0825085 2/1998

* cited by examiner

*Primary Examiner*—S. Joseph Morano
*Assistant Examiner*—Lars A. Olson
(74) *Attorney, Agent, or Firm*—Ladas & Parry

(57) ABSTRACT

Disseminated traction arrangement applied to single-axle train wheel sets provided with independent wheels, comprising, for each wheel (7), a traction motor (8), an extensible shaft (9) which, at one of its ends, is connected to the axle of the traction motor (8) and, at its other end, ends in a pinion (5), and a crown wheel (6) connected to the axle (15) of the wheel (7) and which engages, with the pinion (5) mounted on the shaft (9), so that by means of the pinion-crown group (5, 6) thus formed, the traction power generated by the motor (8) is transmitted to the wheel (7). The invention is applicable to wheel sets incorporated in the connection area between two adjacent train waggons.

13 Claims, 3 Drawing Sheets

DISSEMINATED TRACTION ARRANGEMENT APPLIED TO SINGLE-AXLE TRAIN WHEEL SETS PROVIDED WITH INDEPENDENT WHEELS

FIELD OF THE INVENTION

This invention refers to a disseminated traction arrangement applied to single-axle train wheel sets provided with independent wheels. Specifically, the invention is applicable to TALGO® wheel sets or others of similar design.

As is known, TALGO® wheel sets consist of a wheel attached to a short axle housed at its end in respective bearing cases, one inner and one outer. These wheel sets are incorporated in the connection between two train wagons.

BACKGROUND OF THE INVENTION

In order to reach high speeds of 300–350 km/h, it is necessary to have great power. Likewise, to prevent the vehicles which travel at such speeds from causing unacceptable damage to the track, it is necessary that their weight per axle does not exceed 17 tons. Due to this circumstance, it is not easily possible for those corresponding to the traction heads to be the only motor axles, as there is not enough adherent weight, which makes one fall back upon what is known as "disseminated traction", that is, that all or most of the axles are motor axles.

What this solution achieves is that all or almost all the weight that gravitates on the vehicle's wheels is adherent weight, which will allow not only markedly greater power, but also a marked total force in the wheel rims, without running the risk that slippage may be caused.

Attempts have already been made in the state of the art to devise a system in which the traction applied to a train comes not only from the locomotive, but also from motor axles incorporated in the wagons of the train. An example of this described in EP-A-0 825 085, which refers to a tractor bogie provided with a toothed extensible axle which is mounted between each pair of opposing wheels and to which the traction power generated by a motor is transmitted to make the wheels turn.

SUMMARY OF THE INVENTION

Starting from the known state of the art, the applicant has developed a disseminated traction arrangement applied to single-axle train wheel sets provided with independent wheels which is characterised in that, for each wheel, it comprises:

- a traction motor;
- an extensible shaft which has a homo-kinetic type joint, or similar, close to each of its ends and which, at one of the said ends, is connected to the axle of the traction motor and, at the other end, ends in a pinion; and
- a crown wheel connected to the axle of the wheel and which engages, directly or by means of an intermediate gearwheel, with the pinion mounted on the shaft which comes from the traction motor, so that by means of the pinion-crown group thus formed, the traction power generated by the motor is transmitted to the wheel.

According to an embodiment of the invention, the said pinion is a bevel pinion and the said crown is a bevel crown which engages directly with the pinion and is mounted on the inner side of the wheel, so that the traction generated by the motor is applied to the inner end of the wheel axle.

According to another embodiment of the invention, the said pinion is a spur pinion and the said crown is a spur crown which engages with the pinion by means of an intermediate spur gearwheel and is mounted on the outer side of the wheel, so that the traction generated by the motor is applied to the outer end of the wheel axle.

In both embodiments of the invention, the traction motor is hung from the body of a train wagon, which prevents an increase in non-suspended mass.

BRIEF DESCRIPTION OF THE DRAWINGS

The foregoing and other essential features of the invention will become clearer from reading the following specification with reference to the attached drawings, in which.

DETAILED DESCRIPTION OF THE INVENTION

Figure 1:
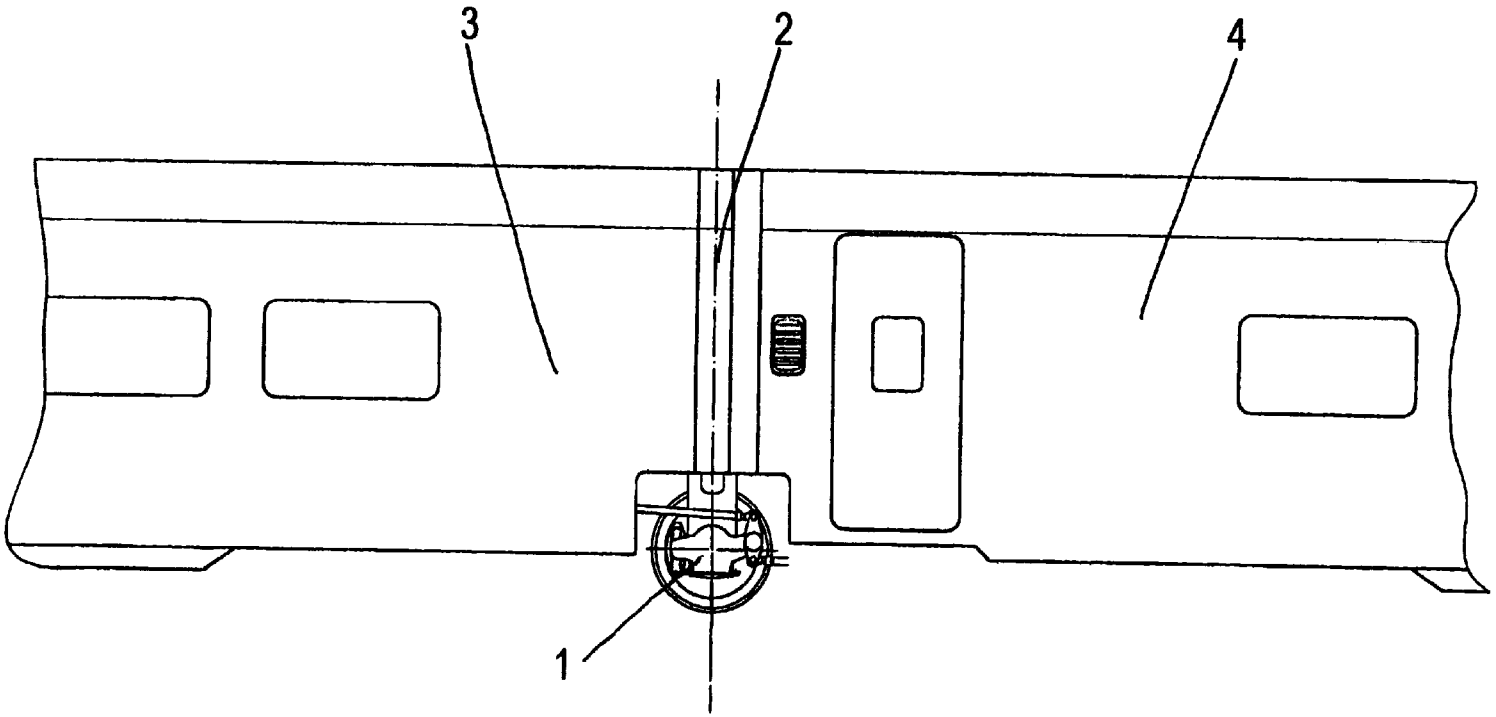
FIG. 1 is a diagrammatic view in side elevation showing the mounting of a single-axle wheel set of independent wheels in the connection between two train waggons.

With reference to the drawings, in which reference is made only to those elements necessary to comprehend the invention, in FIG. 1 we observe the assembly of a single-axle wheel set (1) of independent wheels in the connection area (2) between two adjacent train wagons.

According to the invention, the wheel set (1) is provided with its own traction arrangement which may belong to one of the following types: a first type, called type I, in which the traction is applied to the inner ends of the wheel axles, and a second type, called type II, in which the traction is applied to the outer ends of the wheel axles.

The two types of traction I and II will now be described, with reference to FIGS. 2 and 3 respectively.

Figure 2:
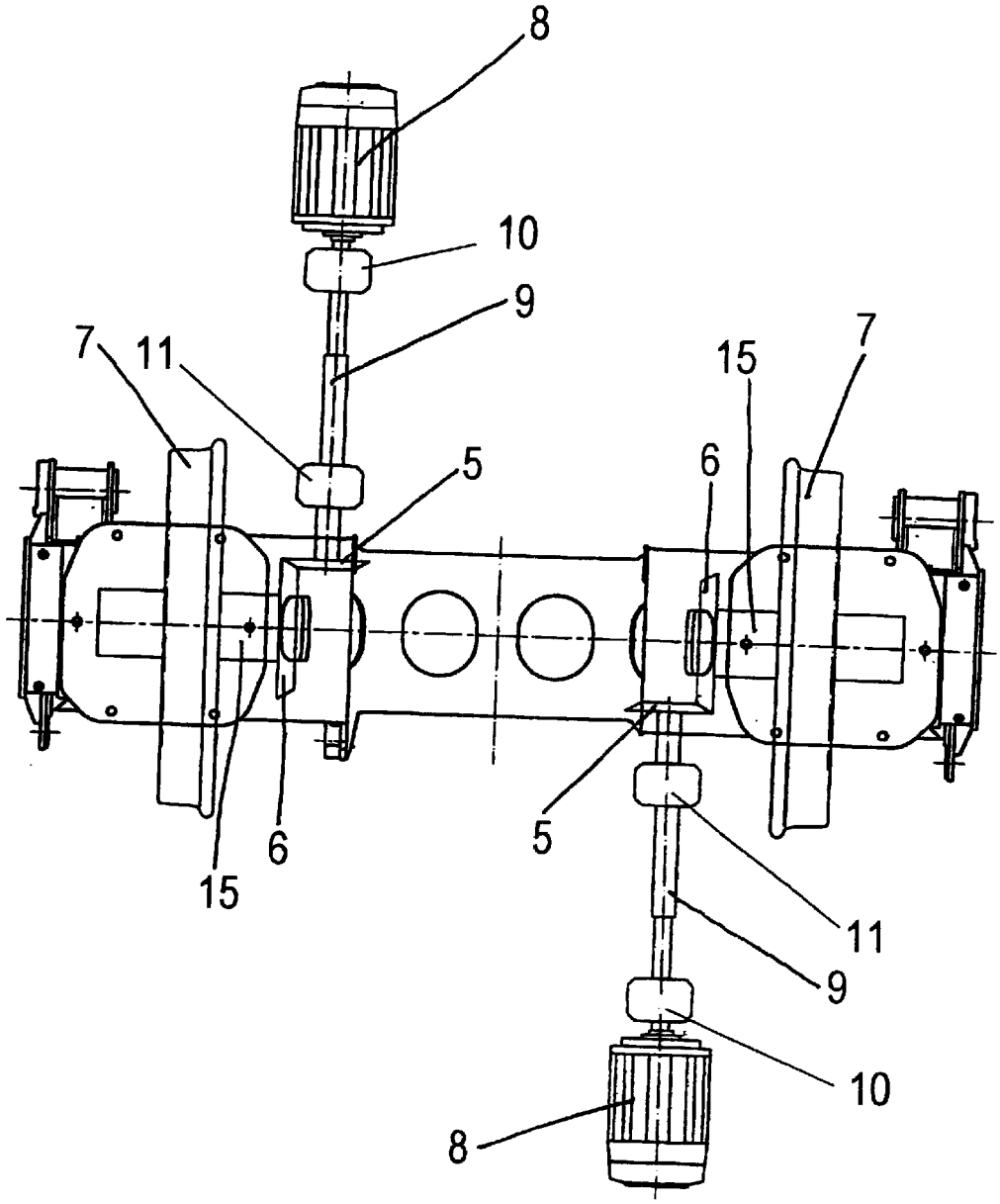
FIG. 2 is a diagrammatic view of a first embodiment of the disseminated traction arrangement developed by the invention.

In type I of traction, shown in FIG. 2, a bevel group of pinion-crown (5, 6) transmits to each wheel (7) of the wheel set (1) the traction power generated by a motor (8) and thus causes the wheels (7) to turn.

The traction power of the motor (8) is transmitted by means of an extensible intermediate shaft (9) incorporated between the pinion (5) of the bevel pinion-crown group and the axle of the motor (8). The said shaft (9) is provided with two joints (10, 11) of the homo-kinetic type or similar.

The said intermediate shaft (9) serves to absorb the relative movements of the bodies of the train wagons (3 and 4) with respect to the wheel set (1), arising from negotiating a curve, vertical oscillation of the suspension of the wagons (3, 4) and transverse warping of the latter.

Figure 3:
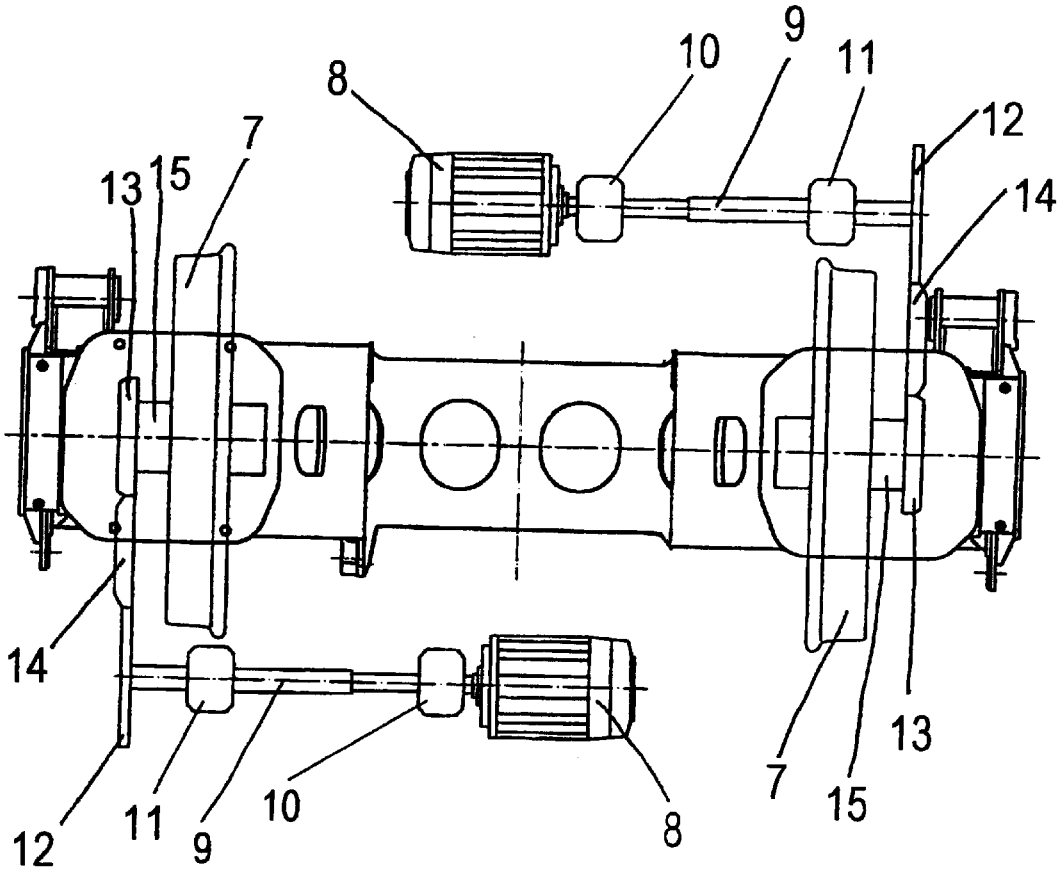
FIG. 3 is a diagrammatic view of a second embodiment of the disseminated traction arrangement developed by the invention.

Type II of disseminated traction shown in FIG. 3 is equivalent to the type I of traction described with reference to FIG. 2, and therefore the same reference numbers have been used in FIG. 3 to identify components which are already shown in FIG. 2. In comparison with type I, the only difference offered by type II of traction is that the pinion-crown group is not a bevel one, but rather in the form of parallel axes. This group is made up of a spur pinion (12) and a spur crown (13) which engage with an intermediate spur gear wheel (14).

As may be observed in the diagrammatic representations of FIGS. 2 and 3, the traction power of the motors (8) is transmitted by the intermediate shafts (9) to the pinions (5)

(FIG. 2) or (12) (FIG. 3) and from here to the crowns (6) (FIG. 2) or (13) (FIG. 3) which, in turn, make the short axles (15) to which the wheels (7) are attached turn. In the case of FIG. 2, traction power is transmitted by the direct operation of the pinion (5) on the crown (6), while in the case of FIG. 3 it was considered preferable to insert an intermediate gear wheel (14) between the pinion (12) and the crown (13).

The traction arrangement of the present invention represents a simple and effective means of distributing traction power between multiple train axles, achieving great adherence of the wheels of train vehicles on the tracks without exceeding the established weight limit of 17 tons per axle and allowing them to reach speeds of 300 km/h or more with wheel sets provided with such a traction arrangement, especially with TALGO® wheel sets or the like.

Although the foregoing description has been given with reference to two preferred embodiments of the invention, it is clear that the basic inventive idea could also have other embodiments. For this reason, the invention must not be considered to be limited to the two embodiments described in this specification and illustrated in the drawings, but rather its scope is to be defined solely by the content of the attached claims.

What is claimed is:

1. A disseminated traction arrangement applied to single-axle train wheel sets provided with independent wheels, in which each wheel set (1) consists of a wheel (7) attached to a short axle (15) housed at its ends in respective bearing cases, one inside and the other outside, each wheel (1) being disposed in a connection area (2) between two adjacent train wagons (3, 4), wherein, for each wheel (7), the traction arrangement comprises:

a traction motor(8);

an extensible shaft (9) which has a joint (10, 11) of homo-kinetic type, close to each one of its ends and which, at one of the said ends, is connected to the traction motor (8) and, at its other end, supports a pinion (5; 12); and a crown wheel (6; 13) connected to the axle (15) of the wheel (7) and which engages, either directly or by means of an intermediate gearwheel (14), with the pinion (5; 12) mounted on the shaft (9) which comes from the traction motor (8), so that by means of the pinion-crown group (5, 6; 12, 13, 14) thus formed, the traction power generated by the motor (8) is transmitted to the wheel (7).

2. An arrangement as claimed in claim 1, wherein the pinion (5) is a bevel pinion and the crown (6) is a bevel crown which engages directly with the pinion (5) and is mounted on the inner side of the wheel (7), so that the traction generated by the motor (8) is applied to the inner end of the axle (15) of the wheel (7).

3. An arrangement as claimed in claim 1, wherein the pinion (12) is a spur pinion and the crown (13) is a spur crown which engages with the pinion (12) by means of an intermediate spur gearwheel (14) and is mounted on the outer side of the wheel (7), so that the traction generated by the motor (8) is applied to the outer end of the axle (15) of the wheel (7).

4. An arrangement as claimed in claim 1, wherein the traction motor (8) is hung from a body of a train wagon (3; 4).

5. An arrangement as claimed in claim 2, wherein the traction motor (8) is hung from a body of a train wagon (3; 4).

6. An arrangement as claimed in claim 3, wherein the traction motor (8) is hung from a body of a train wagon (3; 4).

7. An arrangement as claimed in claim 2, wherein said extensible shaft extends perpendicular to the wheel axle.

8. An arrangement as claimed in claim 3, wherein said extensible shaft extends parallel to the wheel axle.

9. A train comprising a plurality of adjacent connected wagons and a wheel set between adjacent wagons, said wheel set comprising a pair of wheels rollably supporting the wagons, each wheel having an axle rotatable about an axis of rotation, and a drive for driving each wheel in rotation, the drive for each wheel comprising a telescopic shaft having opposite ends with homokinetic joints at said ends, a traction motor hung from a respective wagon, one of the homokinetic joints being drivingly connected to said traction motor, a pinion drivingly connected to the other homokinetic joint, and a crown wheel drivingly connected to the respective wheel and driven by said pinion so that rotation of the wheel is produced by the traction motor via the pinion and crown.

10. The train of claim 9, wherein the wheels have inner and outer surfaces and the wheel axles extend inwardly at the inner surfaces of the wheels, the traction motors being disposed between the wheels and the crown wheels being disposed on the wheel axles in facing relation with the wheels.

11. The train of claim 10, wherein the telescopic shafts extend perpendicularly to said axis in opposite directions.

12. The train of claim 9, wherein the wheels have inner and outer surfaces and the wheel axles extend outwardly from the wheels, the traction motors being disposed between the wheels, the crown wheels being disposed on the wheel axles outside the outer surfaces of the wheels.

13. The train of claim 12, wherein the telescopic shafts extend in opposite directions from the traction motors parallel to said axis.

* * * * *